US009620315B2

(12) United States Patent
Terada et al.

(10) Patent No.: US 9,620,315 B2
(45) Date of Patent: Apr. 11, 2017

(54) GAS CIRCUIT BREAKER

(71) Applicant: Hitachi, Ltd., Chiyoda-ku, Tokyo (JP)

(72) Inventors: Masanao Terada, Tokyo (JP); Hajime Urai, Tokyo (JP); Katsuhiko Shiraishi, Tokyo (JP); Yoichi Oshita, Tokyo (JP); Hiroaki Hashimoto, Tokyo (JP); Noriyuki Yaginuma, Tokyo (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 14/912,794

(22) PCT Filed: May 26, 2014

(86) PCT No.: PCT/JP2014/063778
§ 371 (c)(1),
(2) Date: Feb. 18, 2016

(87) PCT Pub. No.: WO2015/029516
PCT Pub. Date: Mar. 5, 2015

(65) Prior Publication Data

US 2016/0203927 A1 Jul. 14, 2016

(30) Foreign Application Priority Data

Aug. 29, 2013 (JP) ..... 2013-177484

(51) Int. Cl.
*H01H 33/42* (2006.01)

(52) U.S. Cl.
CPC ..... *H01H 33/42* (2013.01); *H01H 2205/002* (2013.01)

(58) Field of Classification Search
CPC ..... H01H 33/42; H01H 33/56; H01H 33/563; H01H 33/565; H01H 2205/002
(Continued)

(56) References Cited

U.S. PATENT DOCUMENTS 6,177,643 B1 1/2001 Marin et al.
6,271,494 B1 8/2001 Dienemann et al.
(Continued)

FOREIGN PATENT DOCUMENTS

JP 2002-208336 A 7/2002
JP 2003-109480 A 4/2003
JP 2012-28106 A 2/2012

OTHER PUBLICATIONS

International Search Report (PCT/ISA/210) issued in PCT Application No. PCT/JP2014/063778 dated Aug. 19, 2014 with English-language translation (two(2)pages).

*Primary Examiner* — Renee S Luebke
*Assistant Examiner* — William Bolton
(74) *Attorney, Agent, or Firm* — Crowell & Moring LLP

(57) ABSTRACT

Provided is a gas circuit breaker that can reduce control energy smaller than that in previous double motion systems and an excessive force applied to a moveable pin to achieve a highly reliable double motion system. A gas circuit breaker has a double motion mechanism unit including a driving-side connecting rod, a driven-side connecting rod, a lever to connect the rods, and a guide to define the motion of the driving-side and driven-side connecting rods. A moveable pin extends through a first grooved cam of the driving-side conencting rod, a second grooved cam of the guide, and a third grooved cam of the lever. The driving-side connecting rod operates to move the moveable pin inside the grooved cams. Thus, the lever is rotated, the driven-side connecting rod is driven opposite to the driving-side connecting rod, and the driven-side arcing contact is driven opposite to the driving-side arcing contact.

12 Claims, 10 Drawing Sheets

(58) Field of Classification Search
USPC ..... 218/154, 155, 97, 57, 59, 60, 61, 65
See application file for complete search history.

(56) References Cited

U.S. PATENT DOCUMENTS

| | | | | | |
|---|---|---|---|---|---|
| 7,339,132 | B2 * | 3/2008 | Urai | ..... | H01H 33/904 218/57 |
| 7,642,480 | B2 * | 1/2010 | Ozil | ..... | H01H 33/904 218/14 |
| 8,013,268 | B2 * | 9/2011 | Ozil | ..... | H01H 33/904 218/1 |
| 8,304,677 | B2 * | 11/2012 | Yoon | ..... | H01H 33/904 218/78 |

* cited by examiner

GAS CIRCUIT BREAKER

TECHNICAL FIELD

The present invention relates to a gas circuit breaker, and more specifically to a gas circuit breaker preferable to ones provided with a double motion mechanism to drive contacts in opposite directions.

BACKGROUND ART

For a gas circuit breaker for use in a high-voltage electric power system, a gas circuit breaker referred to as a puffer type is widely used. The puffer type gas circuit breaker uses an increase in an arc extinguishing gas pressure in the midway point of a contact opening operation, in which a compressed gas is blown to an arc produced between contacts for breaking an electric current.

In order to improve the breaking performance of the puffer type gas circuit breaker, a double motion system has been proposed in which a driven-side electrode, which is fixed in previously existing systems, is driven in the direction opposite to the driving direction of a driving-side electrode.

For example, PTL 1 proposes a system using a fork type lever. In PTL 1, a pin in association with the motion of driving-side components contacts the curved portion of a fork to rotate the fork type lever. The rotational motion is converted into reciprocating motion. in opening and closing directions. Thus, a driven-side arcing contact is driven in the direction opposite to the driving direction of a driving-side electrode. The position of the lever is maintained, with the pin being apart from the curved portion of the fork, and the driven-side arcing contact is at rest.

PTL 1 is intended to efficiently move the driven-side arcing contact with the minimum driving force in a time domain necessary to break an electric current.

PTL 2 proposes a double motion system using a grooved cam. This is a system in which a pin moves inside the grooved cam in association with the motion of driving-side components, this motion rotates the grooved cam, and consequently, a driven-side arcing contact in connection to the grooved cam is driven in the direction opposite to a driving-side arcing contact. The grooved cam can have any shapes, which can achieve desired velocity ratios of the driven-side arcing contact to the driving-side arcing contact.

CITATION LIST

Patent Literatures

PTL 1: U.S. Pat. No. 6,271,494
PTL 2: JP 2003-109480 A

SUMMARY OF INVENTION

Technical Problem

However, the shape of the fork type lever described in PTL 1 is configured only of a straight portion and a forked. portion. Thus, PTL 1 has a problem in that the free settings of the velocity of the driven-side arcing contact are not allowed. The pin contacts the curved portion of the fork type lever every time in opening and closing operations. This causes concern that an excessive force is applied to the fork type lever.

According to PTL 2, the velocity of the driven-side arcing contact can be freely set with the grooved cam. However, since the grooved cam is configured of one grooved cam, the movable pin inside the grooved cam always moves in association with the motion of the driving-side arcing contact. Consequently, it is difficult to restrict the motion of the driven-side arcing contact in a desired time domain. In order to move the driven-side arcing contact in the direction opposite to the motion of the driving-side arcing contact, it is necessary to rotate the movable pin, causing a problem of an increase in the size of the barker because of the grooved cam in a nearly arc shape.

The present invention made in view of the circumstances described above. It is an object of the present invention to provide a gas circuit breaker that can of course attain a grooved cam shape to minimize the energy of a controller, with breaking performance being provided, can reduce control energy smaller than the control energy of previously existing double motion system, and can reduce an excessive force applied to a movable pin to achieve a highly reliable double motion system.

Solution to Problem

To achieve the above problem, a gas circuit breaker of the present invention includes a driving-side electrode and a driven-side electrode provided in a sealed tank, the driving-side electrode and the driven-side electrode being opposed to each other, wherein the driving-side electrode has a driving-side main electrode and a driving-side arcing contact, the driven-side electrode has a driven-side main electrode and a driven-side arcing contact, the driving-side arcing contact is in connection to a controller, the driven-side arcing contact is in connection to a double motion. mechanism unit, the double motion mechanism unit includes a driving-side connecting rod for receiving driving force from the driving-side electrode, a driven-side connecting rod in connection to the driven-side arcing contact, a lever for moving the driven-side connecting rod in an opposite direction in response to motion of the driving-side connecting rod, and a guide for defining motion of the driving-side connecting rod and motion of the driven-side connecting rod, the driving-side connecting rod has a first grooved cam, the guide has a second grooved cam, the lever has a third grooved cam, a movable pin extends through the first grooved cam, the second grooved cam, and the third grooved cam, and with motion of the driving side rod, the movable pin moves inside the first grooved cam, the second grooved cam, and the third grooved cam, the lever is rotated, the driven-side connecting rod is driven in a direction opposite to the driving-side connecting rod, and the driven-side arcing contact in connection to the driven-side connecting rod is driven in a direction opposite to the driving-side arcing contact of the driving-side electrode in connection to the driving-side connecting rod.

Advantageous Effects of Invention

According to the present invention, there can be achieved a highly reliable double motion system that can not only of course attain a grooved cam shape to minimize the energy of a controller, with breaking performance being provided, can reduce control energy smaller than the control energy of previously existing double motion systems, but also reduce an excessive force applied to a movable pin.

DESCRIPTION OF EMBODIMENTS

Figure 1:
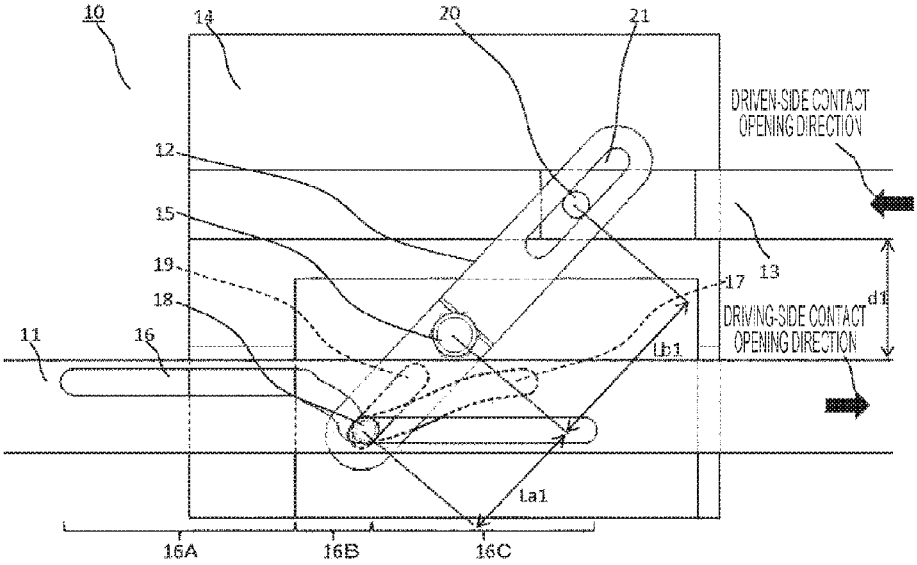
FIG. 1 is a detailed diagram illustrating a double motion mechanism of a puffer type gas circuit breaker according to a first embodiment of a gas circuit breaker according to the present invention.

In the following, referring to the drawings, a gas circuit breaker according to embodiments of the present invention will be described. The embodiments below are merely examples, which will not limit the content of the present invention to specific modes below. The percent invention itself can be implemented in various modes according to the content described in claims. Moreover, in the following embodiments, an example is taken and described in which a breaker includes a mechanical compression chamber and a thermal expansion chamber. However, for example, the present invention is applicable to a breaker having only a mechanical compression chamber.

First Embodiment

Figure 2:
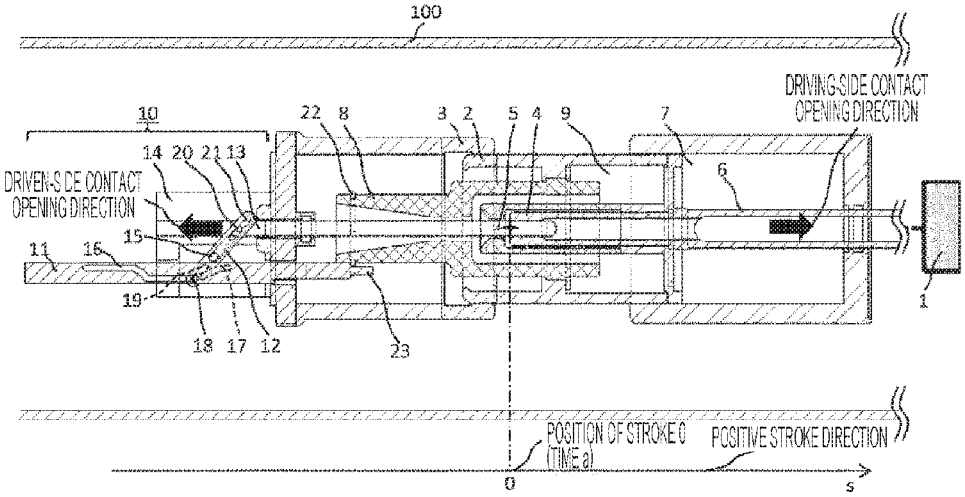
FIG. 2 is a diagram illustrating the puffer type gas circuit breaker according to the first embodiment of the gas circuit breaker according to the present invention in a contact closing state.

FIG. 2 illustrates a state in which a puffer type gas circuit breaker according to a first embodiment of the present invention is turned on.

As illustrated in FIG. 2, in a sealed tank 100, a drive electrode and a driven electrode are disposed as coaxially opposed to each other. The driving-side electrode includes a driving-side main electrode 2 and a driving-side arcing contact 4. The driven electrode includes a driven-side main electrode 3 and a driven-side arcing contact 5.

A controller 1 is provided adjacent to the sealed tank 100. A shaft 6 to transmit a driving force is in connection to the controller 1. The driving-side arcing contact 4 is provided at the tip end of the shaft 6. The shaft 6 is provided to extend through inside a mechanical compression chamber 7 and a thermal expansion chamber 9 On the breaking unit side of the thermal expansion chamber 9, the driving-side main electrode 2 and a nozzle 8 are provided. The driven-side arcing contact 5 is provided on the same axis as opposed to the driving-side arcing contact 4. One end of the driven-side arcing contact 5 and the tip end of the nozzle 8 are in connection to a double motion mechanism unit 10.

As illustrated in FIG. 2, in the turn-on state, the puffer type gas circuit breaker is set at a position at which the driving-side main electrode 2 is conducted to the driven-side main electrode 3 with an oil pressure or a spring of the controller 1. This configures the circuit of an electric power system in normal operation.

In breaking a short-circuit current caused by a lightning strike, for example, the controller 1 is driven in a contact opening direction, and the driving-side main electrode 2 is brought away from the driven-side main electrode 3 through the shaft 6. In the separation, an arc is generated between the driving-side arcing contact 4 and the driven-side arcing contact 5. The arc is extinguished with mechanical arc extinguishing gas blow from the mechanical compression chamber 7 and an arc extinguishing gas blow using arc heat from the thermal expansion chamber 9. Thus, the electric current is broken.

In order to reduce the control energy of the puffer type gas circuit breaker, the double motion mechanism 10 is provided to drive the driven-side arcing contact 5, which is previously fixed, in the direction opposite to the driving direction of the driving-side contact 4.

In the following, referring to FIGS. 1 and 3, the double motion system of the puffer type gas circuit breaker according to the first embodiment of the present invention will be described.

Figure 3:
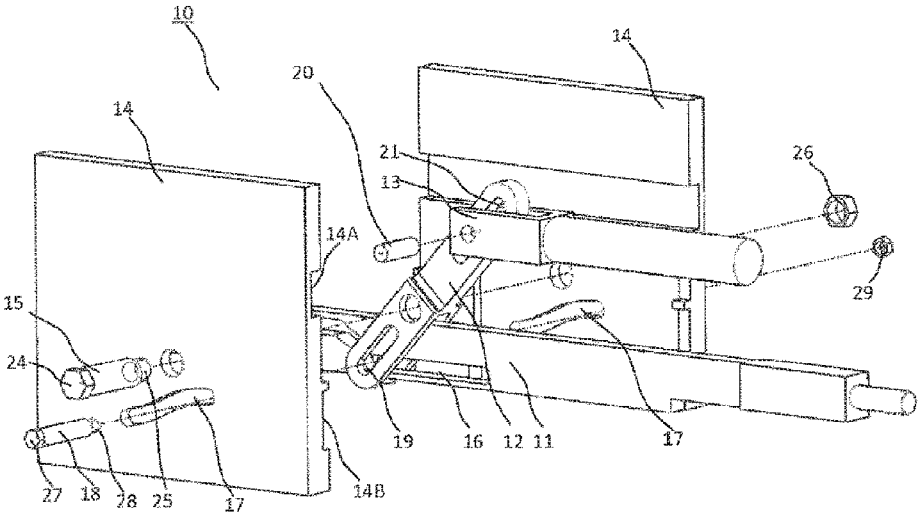
FIG. 3 is an exploded perspective view illustrating the double motion mechanism of the puffer type gas circuit breaker according to the first embodiment of the gas circuit breaker according to the present invention.

As illustrated in FIGS. 1 and 3, the double motion mechanism 10 according to the embodiment is configured in which a driven-side connecting rod 13 is in connection to a driving-side connecting rod 11 through a lever 12 rotatably provided on a guide 14, with the driven-side connecting rod 13 and the driving-side connecting rod 11 being movably held by the guide 14 in the direction of breaking operation.

The driving-side connecting rod 11 is provided with a first grooved cam 16. The guide 14 is provided with a second grooved cam 17. The lever 12 is provided with a third grooved cam 19. A movable pin 18 extends through the second grooved cam 17, the first grooved cam 16, and the third grooved cam 19.

In order to prevent the movable pin 18 from being detached, a movable pin hexagon head 27 is provided at one end of the movable pin 18, and a movable pin fastening screw 28 is cut at the other end. The movable pin fastening screw 28 is fastened with a movable pin fixing nut 29, with the guide 14 being sandwiched. In the fastening, the length of the tubular portion of the movable pin 18 is equal to or greater than the thickness of the stacking direction of the guide 14 so that the movable pin 18 is freely movable inside the grooved cams.

With this configuration, the movable pin 18 is allowed to freely move inside the grooves without being fixed to any components.

Similarly, a lever fixing pin 15 is provided with a lever fixing pin hexagon head 24 at one end of the lever fixing pin 15, and a lever fixing pin fastening screw 25 is cut at the other end. The lever fixing pin fastening screw 25 is fastened with a lever fixing pin fixing nut 26, with the guide 14 being sandwiched.

In order to prevent the lever fixing pin 15 and the movable pin 18 from being detached from the guide 14, in addition to the configuration described above, a configuration may be possible in which a groove is cut at both ends of the pin and a snap ring is fit to each of the grooves.

Desirably, the lever 12 has a bilaterally symmetrical shape in order not to apply a force directed perpendicularly to the contact opening direction. The embodiment has a structure in which the lower part of the lever divided into two so as to sandwich the driving-side connecting rod 11.

The first grooved cam 16 cut in the driving-side connecting rod 11 is configured of a second straight portion 16C, a connecting portion 16B, and a first straight portion 16A when viewed from the controller.

The first and second straight portions 16A and 16C are provided on different axes, and the connecting portion 16B is provided between them. The vertical displacement range of the first grooved cam 16 is configured to fit within the vertical displacement range of the second grooved cam 17 and the vertical displacement range of the third grooved cam 19.

The shape of the connecting portion 16B can be freely designed suitable for the operation characteristics of the breaking unit. For example, the shape may be curved or straight.

The vertical displacement of the driving-side connecting rod 11 is restricted by grooves (grooves 14A and 14B in FIG. 3) provided on the guide 14. The driving-side connecting rod 11 is movable only in the horizontal direction of the moving axis of the breaking unit.

As illustrated in FIG. 1, the second grooved cam 17 provided on the guide 14 is cut in a shape the same as the vertical displacement range of the first grooved cam 16. The shape of the second grooved cam 17 can be any shapes. The shape is appropriately changeable according to the breaking operation characteristics.

As described above, the first and second grooved cams 16 and 17 form a stacked structure in the vertical direction of the drawing. The movable pin 18 is disposed on the portion where the grooved cams 16 and 17 overlap with each other (see FIG. 3).

The movable pin 18 extends through the third grooved cam 19 cut in the lever 12. The lever 12 is rotated about the lever fixing pin 15 as the rotation axis.

At this time, when the movable pin 18 moves on the connecting portion 16B of the first grooved cam 16, the movable pin 16 rolls on and along the second grooved cam 17 in one direction. This motion of the movable pin 18 in one direction applies a force on one side of the inner wall of the third grooved cam 19, and the rotation direction of the lever 12 is defined. The shape of the third grooved cam 19 can be any shapes. The shape is appropriately changeable according to the breaking operation characteristics.

With this rotational motion, a lever driven-side guide groove 21 cut in the lever 12 transmits a force to a driven-side moving pin 20 mounted on the driven-side connecting rod 13. Consequently, the driven-side connecting rod 13 in connection to the driven-side arcing contact 5 is allowed to move in the opposite direction of the driving-side connecting rod 11.

A distance d1 between the driving-side connecting rod 11 and the driven-side connecting rod 13 (see FIG. 1) is determined by a difference between the outer diameter of the tip end of the nozzle 8 and the diameter of the driven-side arcing contact 5.

In the case in which the lever 12 angled, a driving-side arm length La1 and a driven-side arm length Lb1 are changed depending on the angle of the lever 12. At any angles, La1<Lb1.

In this case, the force to move the driven-side components is greater than the force in the case of Lb1<La1. However, the weight of the driven-side arcing contact 5 is extremely smaller than the weight of the driving-side components. Thus, this force is no problem specifically. The light-weight driven-side arcing contact 5 can be quickly moved with respect to the driving-side components. Thus, the minimum operating force can provide a necessary relative velocity.

As illustrated in FIG. 2, a structure is provided for connecting the double motion mechanism 10 to the driving-side components. For example, a fastening ring 22 is mounted on the nozzle 8. A hole is provided on the fastening ring 22, through which the tip end of the driving-side connecting rod 11 extends. The tip end of the driving-side connecting rod 11 extends through the fastening ring 22, and a driving-side fastening screw 23 is fastened with a nut.

In the following, referring to FIGS. 4 to 10, states in the midway point of the contact opening operation will be described.

Figure 4:
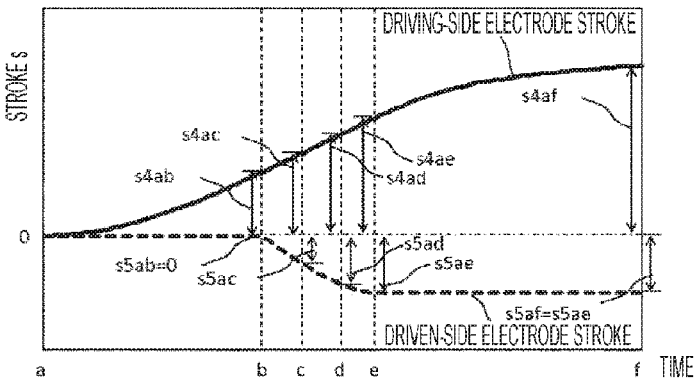
FIG. 4 is a characteristic diagram illustrating the stroke characteristics of the puffer type gas circuit breaker according to the first embodiment of the gas circuit breaker according to the present invention.

FIG. 4 is the stroke characteristics of the puffer type gas circuit breaker. Time is plotted on the horizontal axis. A driving-side electrode stroke and a driven-side electrode stroke are plotted on the vertical axis.

In FIG. 4, time a is contact opening start time. Time b is time at which the driven-side arcing contact 5 is about to move (in the state in FIG. 5). Time c is time at which the movable pin 18 enters the connecting portion 16B of the first grooved cam 16 (in the state in FIG. 6), i.e., time at which the driven-side arcing contact 5 just starts moving. Time d is time at which the movable pin 18 is about to go out the connecting portion 16B of the first grooved cam and the motion of the driven-side arcing contact 5 is in the final stage (in the state in FIG. 7). Time e is time at which the motion of the driven-side arcing contact 5 is being finished (in the state in FIG. 8). Time f is time at which the motion of the driving-side electrode is completed and the contact opening state is reached (in the state in FIG. 9).

For the strokes of the driving-side and driven-side electrodes at the time instants, for example, the stroke of the driving-side arcing contact 4 from time a to time b is expressed as s4ab.

Figure 5:
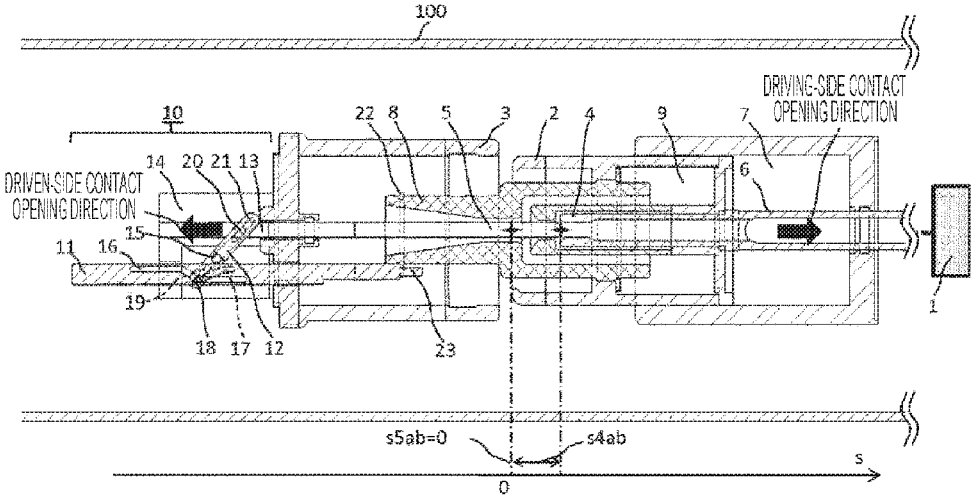
FIG. 5 is a cross sectional view illustrating the puffer type gas circuit breaker according to the first embodiment of the gas circuit breaker according to the present invention in a state in which in the midway point of opening contacts, a driven-side arcing contact is about to move.

FIG. 5 is the state in which the driven-side arcing contact 5 is about to move. In the stroke from time a to time b, the driving-side arcing contact 4 is at the stroke s4ab (≠0), the driven-side arcing contact 5 is at a stroke s5ab (∫0), and the driven-side arcing contact 5 is at rest.

That is, in the time period in which the straight portion of the second straight portion 16C of the first grooved cam passes the movable pin 18, the state is achieved in which the driven-side arcing contact 5 is at rest (in the following, this state is referred to as intermittent drive). Thus, adjusting the length of the second straight portion 16C allows the driven-side electrode to move only in a given time domain.

Figure 6:
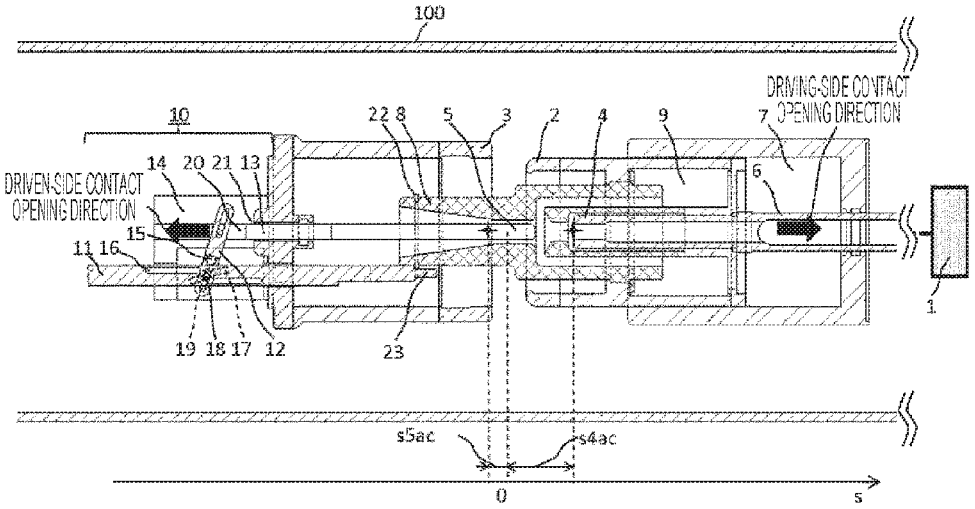
FIG. 6 is a cross sectional view illustrating the puffer type gas circuit breaker according to the first embodiment of the gas circuit breaker according to the present invention in a state in which in the midway point of opening contacts, a movable pin enters the connecting portion of a first grooved cam and the driven-side arcing contact lust starts moving.

FIG. 6 is the state in which the movable pin 18 enters the connecting portion 16B of the first grooved cam and the driven-side arcing contact 5 just starts moving. In the stroke from time a to time c, which is in the state above, the driving-side arcing contact 4 is at a stroke s4ac (>s4ab), and the driven-side arcing contact 5 is at a stroke s5ac (>s5ab). Both of the contacts are in motion. At this time, the movable pin 18 enters the connecting portion 16B of the first grooved cam 16, and simultaneously moves inside the second grooved cam 17 and the third grooved cam 19 in one direction.

Figure 7:
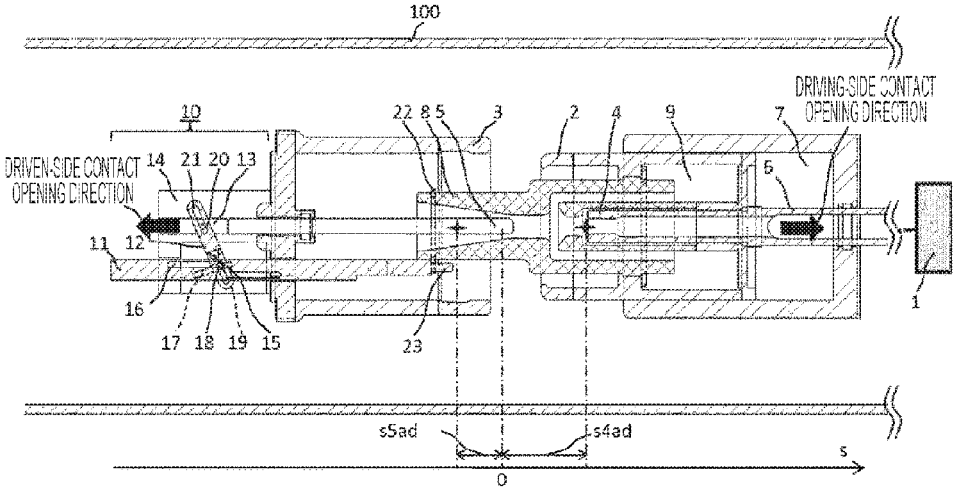
FIG. 7 is a cross sectional view illustrating the puffer type gas circuit breaker according to the first embodiment of the gas circuit breaker according to the present invention in a state in which in the midway point of opening contacts, the movable pin is about to go out the connecting portion of the first grooved cam and the motion of the driven-side arcing contact is in the final stage.

FIG. 7 is the state in which the movable pin 18 is about to go out the connecting portion 16B of the first grooved cam 16 and the motion of the driven-side arcing contact 5 is in the final stage. In the stroke from time a to time d, which is in the state above, the driving-side arcing contact 4 is at a stroke s4ad (>s4ac), and the driven-side arcing contact 5 is at a stroke s5ad (>s5ac). Both of the contacts are in motion. At this time, the movable pin 18 moves on the connecting portion 16B of the first grooved cam 16, and simultaneously moves inside the second grooved cam 17 and the third grooved cam 19 in one direction.

Figure 8:
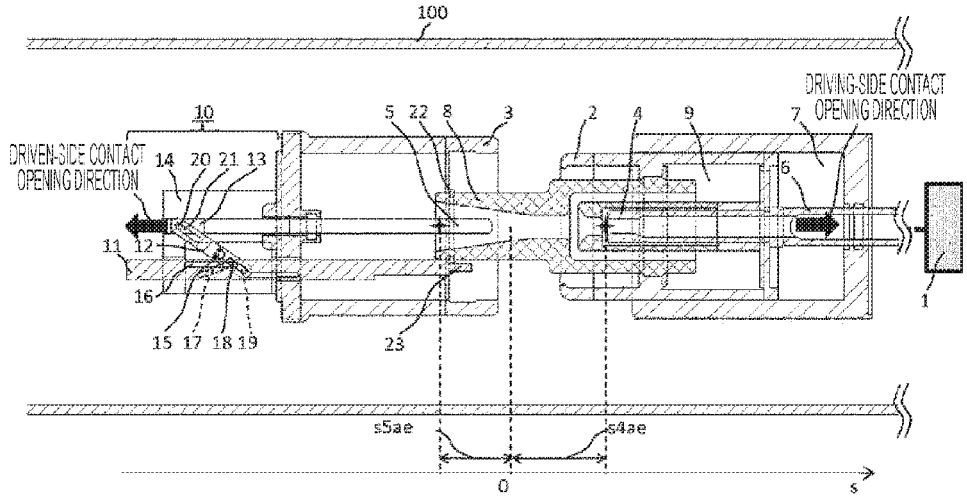
FIG. 8 is a cross sectional view illustrating the puffer type gas circuit breaker according to the first embodiment of the gas circuit breaker according to the present invention in a state in which in the midway point of opening contacts, the motion of the driven-side arcing contact is in the final stage.

FIG. 8 is the state in which the motion of the driven-side arcing contact 5 is being finished. In the stroke from time a to time e, the driving-side arcing contact 4 is at a stroke s4ae (>s4ad), and the driven-side arcing contact 5 is at a stroke s5ae (>s5ad). Both of the contacts are in motion. At this time, the movable pin 18 enters the first straight portion 16A of the first grooved cam, and simultaneously moves inside the second grooved cam 17 and the third grooved cam 19.

Figure 9:
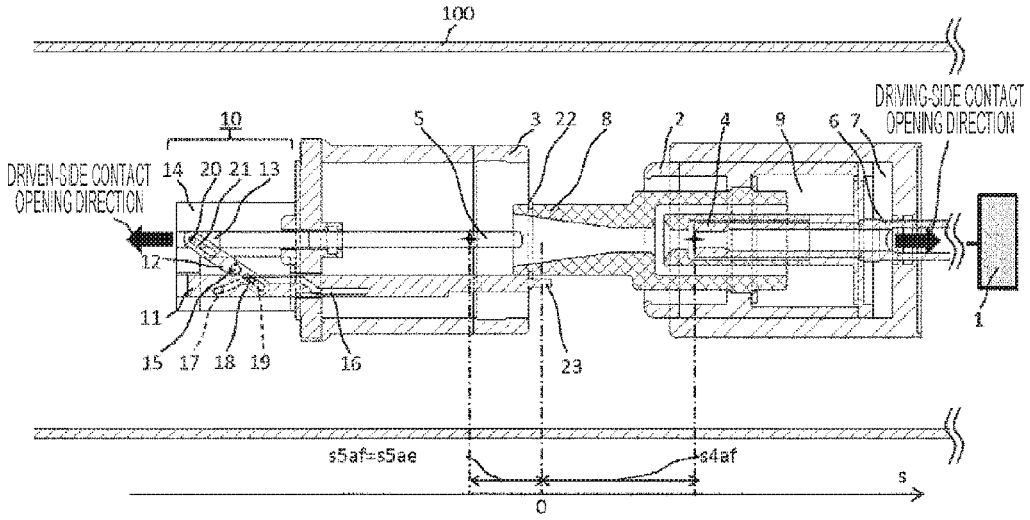
FIG. 9 is a cross sectional view illustrating the puffer type gas circuit breaker according to the first embodiment of the gas circuit breaker according to the present invention in a contact opening state.

FIG. 9 is the contact opening state of the puffer type gas circuit breaker. In the stroke from time a to time f, the driving-side arcing contact 4 is at a stroke s4af (>s4ae), the driven-side arcing contact 5 is at a stroke s5af (=s5ae), and the driven-side arcing contact 5 is at rest. In a time period in which the straight portion of the first grooved cam 16 passes the movable pin 18, the intermittent drive state in which the driven-side arcing contact 5 is at rest is achieved.

In the following, the motion of the lever 12 will be described in relation with the relative motion of the movable pin 18 described above. After starting the contact opening operation, the movable pin 18 moves on the second straight portion 16C until the movable pin 18 reaches the state in FIG. 5. During this motion, the lever 12 is at rest.

In the states in FIGS. 6 and 7, the movable pin 18 moves on the connecting portion 16B. During this motion, the lever 12 is rotated, with the lever fixing pin 15 being a support point. In the states in FIGS. 8 and 9, the movable pin 18 moves on the first straight portion 16A. During this motion, the lever 12 is at rest.

As illustrated in FIGS. 6 and 7, when the movable pin 18 moves on the connecting portion 16B, the movable pin 18 rotates the lever 12 using the lever fixing pin 15 as a support point, with the movable pin 18 moving inside the second grooved cam 17 and the third grooved cam 19 in one direction.

In the contact opening operation of the puffer type gas circuit breaker (FIGS. 5 to 9), the movable pin 18 moves on the second straight portion 16C, the connecting portion 16B, and the first straight portion 16A in one direction. In the turning on operation (FIGS. 9 to 5), the movable pin 18 moves on the first straight portion 16A, the connecting portion 16B, and the second straight portion 16C in one direction.

As described above, the movable pin 18 on the connecting portion 16B of the first grooved cam holds the position of the lever 12 by the second grooved cam 17. Consequently, the movable pin 18 rotates the lever 12 in one direction to drive the driven-side arcing contact 5 in the direction opposite to the driving-side arcing contact 4.

The motion of the movable pin 18 on the first straight portion 16A of the first grooved cam is restricted by the second grooved cam 17 and the third grooved cam 19.

Consequently, the movable pin 18 stops the rotation of the lever 12. Thus, the intermittent drive state in which the driven-side arcing contact 5 is at rest is achieved.

As illustrated in FIG. 3, in the embodiment, the first and second grooved cams 16 and 17 overlap with each other in the axial direction of the movable pin 18, and thus a space-saving double motion mechanism can be achieved. The movable pin 18 is not fixed to any components. This can relax an excessive force applied to the movable pin 18. Therefore, a highly reliable double motion mechanism can be achieved.

Figure 10:
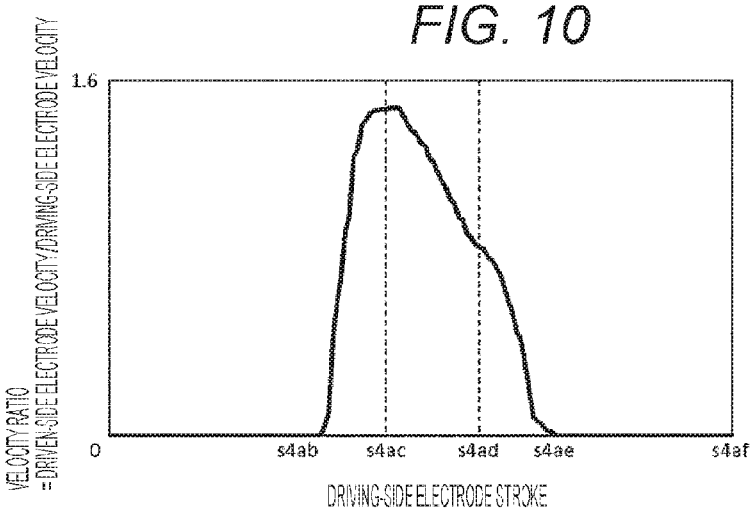
FIG. 10 is a diagram illustrating the velocity ratio of a driving-side arcing contact to the driven-side arcing contact of the puffer type gas circuit breaker according to the first embodiment of the gas circuit breaker according to the present invention.

Next, referring to FIG. 10, the driving-side electrode stroke and the velocity ratio of the driving-side arcing contact 4 to the driven-side arcing contact 5 according to the embodiment will be described.

In the embodiment, when the driving-side arcing contact 4 reaches the stroke s4ab, the driven-side arcing contact 5 starts moving, and the driven-side arcing contact 5 stops at the stroke s4ae. The driven-side arcing contact 5 is accelerated from the stroke s4ab to the stroke s4ac. The driven-side arcing contact 5 is reduced in speed in two steps from the stroke s4ac to the stroke s4ad and from the stroke s4ad to the stroke s4ae. This is a configuration in which at time b (see FIG. 4) at which the driven-side arcing contact 5 goes out the driving-side arcing contact 4, the driven-side arcing contact 5 is quickly accelerated to increase the distance between the contacts for a short time.

This operation is especially effective for small capacitive current breaking. In small capacitive current breaking, the inter-contact dielectric breakdown voltage is necessary to exceed the recovery voltage at every time of breaking. This is because it is necessary to provide the distance between the contacts in a time as short as possible, due to the dependence of the inter-contact dielectric breakdown voltage on the distance between the contacts at each breaking time.

The embodiment shows the grooved cam shape of the double motion mechanism that can achieve the stroke characteristics necessary for small capacitive current breaking. However, there are optimum stroke characteristics for various kinds of breaking duty. These optimum stroke characteristics can be attained by changing the shape of the connecting portion 16 configured of arbitrary curves according to the embodiment.

Adjusting the relationship of positions of the first straight portion 16A, the second straight portion 16C, and the connecting portion 16B of the first grooved cam, the second grooved cam 17, and the third grooved cam 19 allows changing the velocity ratio of the driven-side motion to the driving-side motion.

With the configuration according to the embodiment, the design of the grooved cams can be easily changed suitable for models having different breaking unit structures and different breaking methods, and optimum grooved cam shapes for providing breaking performances can be attained. The movable pin is not fixed to any components, and freely movable inside the grooved cams. Thus, an excessive force applied to the grooved cams in opening and closing operations can be relaxed. The second grooved cam overlaps with the first grooved cam in the axial direction of the movable pin. Therefore, the length of the breaker in the axial direction can be shortened, and thus a space-saving double motion mechanism can be achieved.

Accordingly, according to the embodiment, it is possible to achieve a highly reliable double motion system that can of course attain a grooved cam shape to minimize the energy of a controller, with breaking performance being provided, can reduce control energy smaller than the control energy of previously existing double motion systems, and can reduce an excessive force applied to a movable pin.

Second Embodiment

Figure 11:
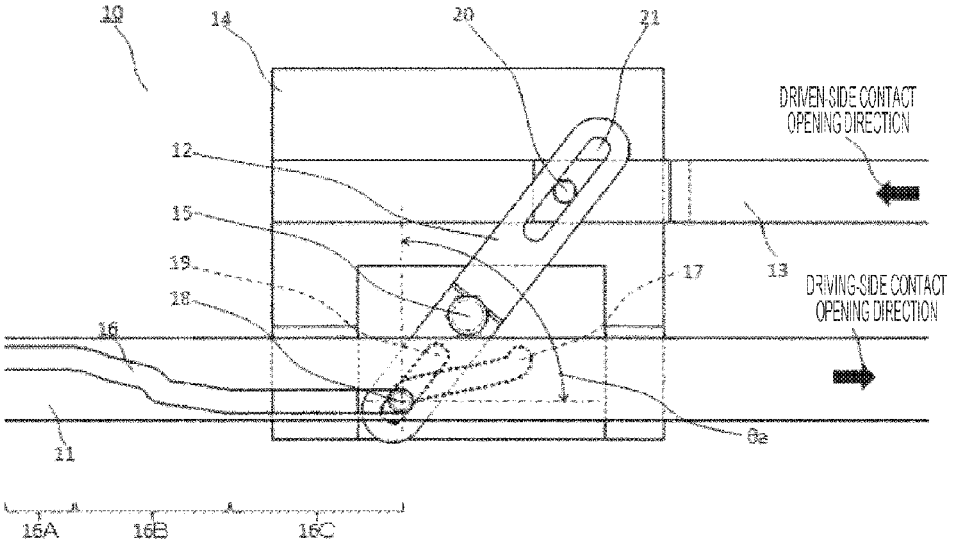
FIG. 11 is a detailed diagram illustrating a double motion mechanism unit of a puffer type gas circuit breaker according to a second embodiment of the gas circuit breaker according to the present invention in a contact closing state.

FIG. 11 is the turn-on state of a puffer type gas circuit breaker according to a second embodiment of the gas circuit breaker according to the present invention, illustrating only a double motion mechanism unit.

A double motion mechanism 10 according to the embodiment is configured in which a driven-side connecting rod 13 is in connection to a driving-side connecting rod 11 through a lever 12 rotatably provided on guide 14, with the driven-side connecting rod 13 and the driving-side connecting rod 11 being movably held by the guide 14 in the direction of a breaking operation.

A first grooved cam 16 is cut in the driving-side connecting rod 11, and configured of a second straight portion 16C, a connecting portion 16B, and a first straight portion 16A when viewed from a controller. The first and second straight portions 16A and 16C are provided on different axes, and the connecting portion 16B is provided between them.

The vertical displacement range of the first grooved cam 16 is configured to fit within the vertical displacement range of a second grooved cam 17 and the vertical displacement range of a third grooved cam 19. The shape of the connecting portion 16B can be freely designed suitable for the operation characteristics of a breaking unit. For example, the shape may be curved or straight.

The vertical displacement of the driving-side connecting rod 11 is restricted by grooves provided on the guide 14 (see grooves 14A and 14B in FIG. 3). The driving-side connecting rod 11 is movable only in the horizontal direction of the moving axis of the breaking unit.

The second grooved cam 17 in a curved shape, for example, is cut in the guide 14 in the same width of the first grooved cam 16 in the vertical direction. Here, a crossing angle (in the following, simply referred to as a crossing angle of the grooved cams) θa formed by tangents passing the intersection point of the first and second grooved cams 16 and 17 with respect to the center lines of the grooved cams is 40 degrees or more and 140 degrees or less. As described. later, this configuration is provided to reduce the contact force across the first and second grooved cams 16 and 17 and the movable pin 18 at the minimum.

The shape of the second grooved cam 17 is not limited to a curved shape. The shape is appropriately changeable according to the breaking operation characteristics. The first and second grooved cams 16 and 17 form a stacked structure in the vertical direction of the drawing. The movable pin 18 is disposed on the portion where these two grooved cams overlap with each other. The two grooved cams and the movable pin 18 are movably in connection to one another (see FIG. 3).

The movable pin 18 extends through the third grooved cam 19 cut in the lever 12, and the lever 12 is rotated about the lever fixing 15 as the rotation axis. At this time, when the movable pin 18 moves on the connecting portion 16B of the first grooved cam, the movable pin 18 rolls on and along the second grooved cam 17 in one direction. This motion of the movable pin 18 in one direction applies a force to one side of the inner wall of the third grooved cam 19, and the rotation direction of the lever 12 is defined. The shape of the third grooved cam 19 can be any shapes. The shape is appropriately changeable according to the breaking operation characteristics.

With this rotational motion, a lever driven-side guide groove 21 cut in the lever 12 transmits a force to a driven-side moving pin 20 mounted on the driven-side connecting rod 13. Consequently, the driven-side connecting rod 13 in connection to the driven-side arcing contact 5 is allowed to move in the opposite direction of the driving-side connecting rod 11.

Figure 12:
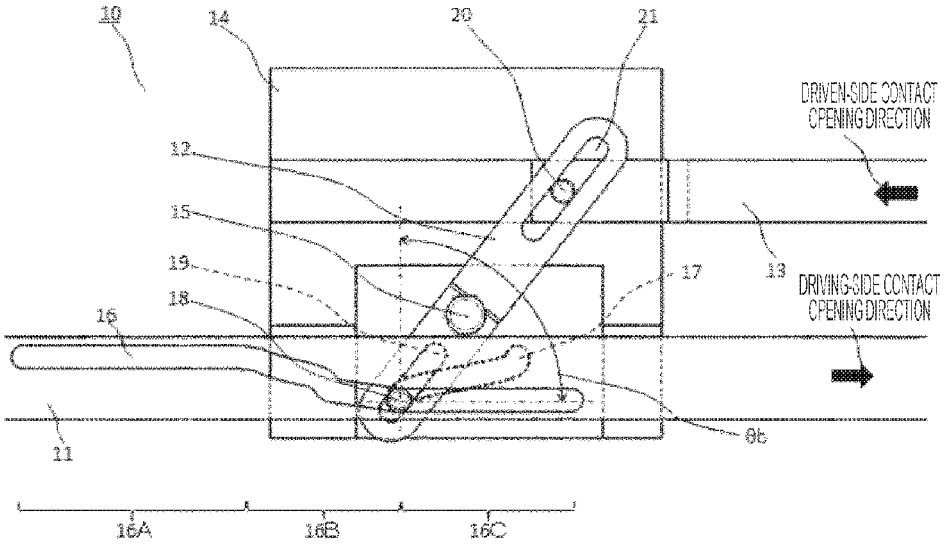
FIG. 12 is a detailed diagram illustrating the double motion mechanism unit of the puffer type gas circuit breaker according to the second embodiment of the gas circuit breaker according to the present invention in a state in which in the midway point of opening contacts, a driven-side arcing contact is about to move.

FIG. 12 is the state in which the driven-side arcing contact 5 is about to move. In the stroke from time a to time b (see FIG. 4), the driving-side arcing contact 4 is at the stroke s4ab (≠0), the driven-side arcing contact 5 is at the stroke s5ab (≠0), and the driven-side arcing contact 5 is at rest. A. crossing angle θb of the first and second grooved cams 16 and 17 in this state is equal to θa. The crossing angle θb is 40 degrees or more and 140 degrees or less.

Figure 13:
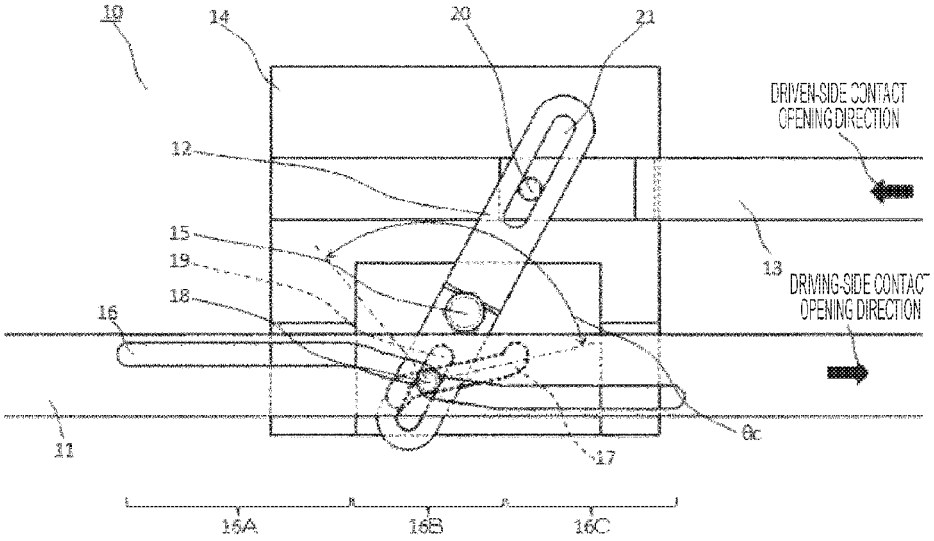
FIG. 13 is a detailed diagram illustrating the double motion mechanism unit of the puffer type gas circuit breaker according to the second embodiment of the gas circuit breaker according to the present invention in a state in which in the midway point of opening contacts, a movable pin enters the connecting portion of a first grooved cam and the driven-side arcing contact just starts moving.

FIG. 13 is the state in which the movable pin 18 enters the connecting portion 16B of the first grooved cam 16 and the driven-side arcing contact 5 just starts moving. In the stroke from time a to time c, which is in the state above (see FIG. 4), the driving-side arcing contact 4 is at the stroke s4ac s4ab), and the driven-side arcing contact 5 is at the stroke s5ac (>s5ab). Both of the contacts are in motion. At this time, the movable pin 18 enters the connecting portion 16B of the first grooved cam 16, and simultaneously moves inside the second grooved cam and the third grooved cam 19 in one direction. A crossing angle θc of the first and second grooved cams 16 and 17 in this state is 40 degrees or more and 140 degrees or less.

Figure 14:
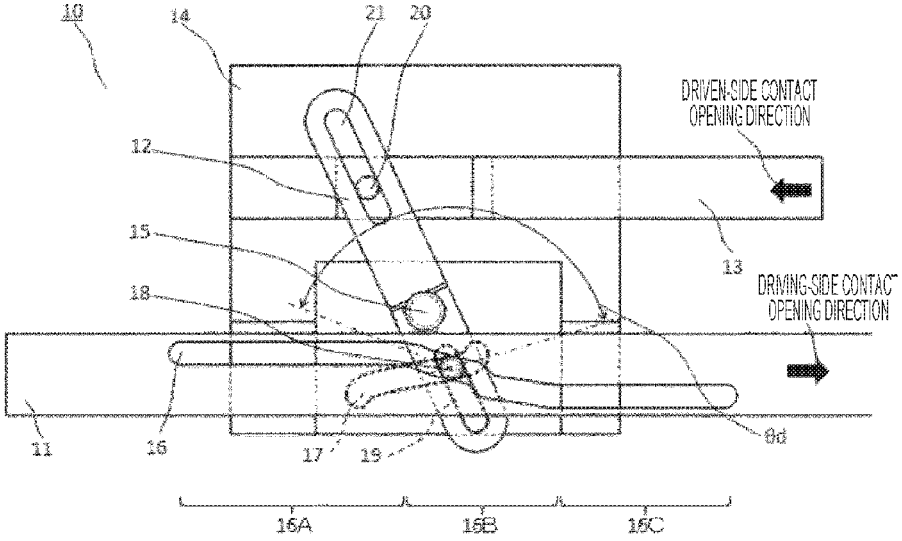
FIG. 14 is a detailed diagram illustrating the double motion mechanism unit of the puffer type gas circuit breaker according to the second embodiment of the gas circuit breaker according to the present invention in a state in which in the midway point of opening contacts, the movable pin is about to go out the connecting portion of the first grooved cam and the motion of the driven-side arcing contact is in the final stage.

FIG. 14 is the state in which the movable pin 18 is about to go out the connecting portion 16B of the first grooved cam 16 and the motion of the driven-side arcing contact 5 is in the final stage. In the stroke from time a to time d, which is in the state above (see FIG. 4), the driving-side arcing contact 4 is at the stroke s4ad (>s4ac), and the driven-side arcing contact 5 at the stroke s5ad (>s5ac). Both of the contacts are in motion. At this time, the movable pin 18 moves on the connecting portion 16B of the first grooved cam 16, and simultaneously moves inside the second grooved cam 17 and the third grooved cam 19 in one direction. A crossing angle θd of the first and second grooved cams 16 and 17 in this state is 40 degrees or more and 140 degrees or less.

Figure 15:
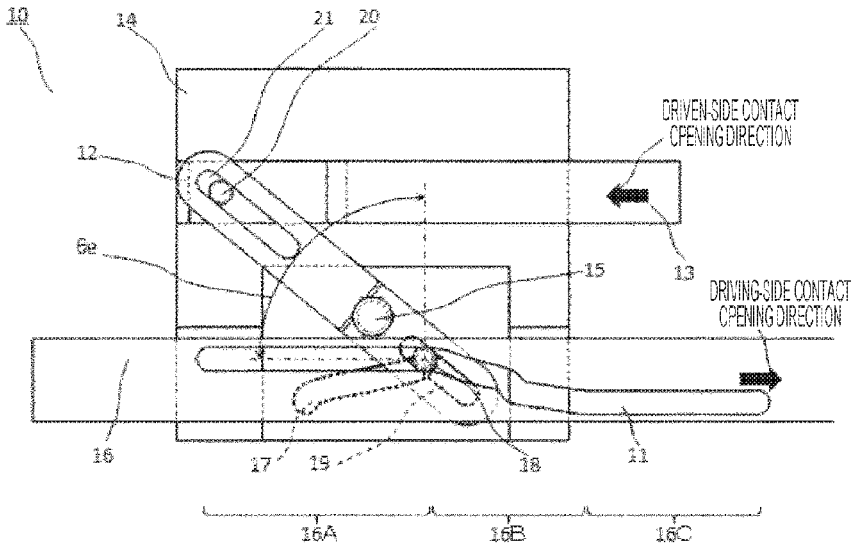
FIG. 15 is a detailed diagram illustrating the double motion mechanism unit of the puffer type gas circuit breaker according to the second embodiment of the gas circuit breaker according to the present invention in a state in which in the midway point of opening contacts, the motion of the driven-side arcing contact is being finished.

FIG. 15 is the state in which the motion of the driven-side arcing contact 5 is being finished. In the stroke from time a to time e (see FIG. 4), the driving-side arcing contact 4 is at the stroke s4ae (>s4ad), and the driven-side arcing contact 5 is at the stroke s5ae (>s5ad). Both of the contacts are in motion. At this time, the movable pin 18 enters the first straight portion 16A of the first grooved cam 16, and simultaneously moves inside the second grooved cam 17 and the third grooved cam 19. A crossing θe of the first and second grooved cams 16 and 17 in this state is 40 degrees or more and 140 degrees or less.

Figure 16:
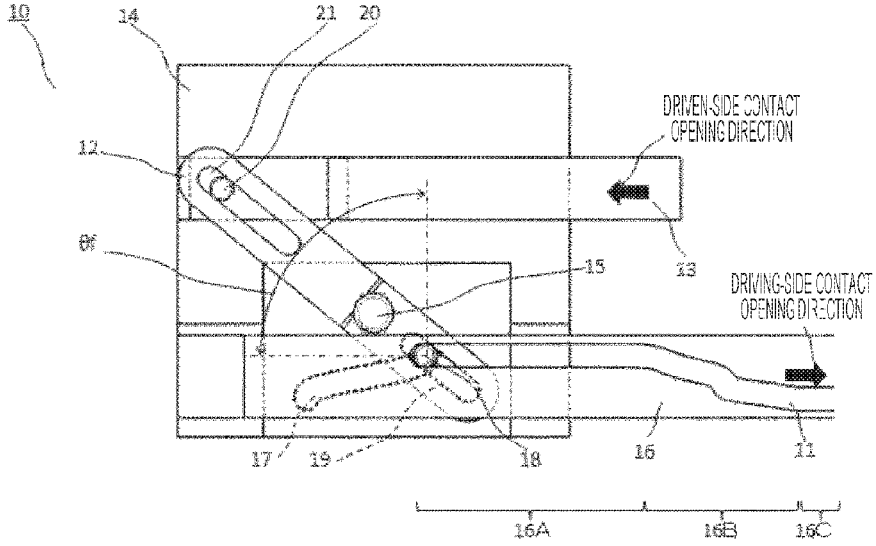
FIG. 16 is a detailed diagram illustrating the double motion mechanism unit of the puffer type gas circuit breaker according to the second embodiment of the gas circuit breaker according to the present invention in a contact opening state.

FIG. 16 is the contact opening state of the puffer type gas circuit breaker. In the stroke from time a to time f (see FIG. 4), the driving-side arcing contact 4 is at the stroke s4af (>s4ae), the driven-side arcing contact 5 is at the stroke s5af (=s5ae), and the driven-side arcing contact 5 is at rest. In a time period in which the straight portion of the first grooved cam 16 passes the movable pin 18, the intermittent drive state in which the driven-side arcing contact 5 is at rest is achieved. A crossing angle θf of the first and second grooved cams 16 and 17 in this state is equal to θe, and is 40 degrees or more and 140 degrees or less.

As described above, in all the operation sections, the crossing angle of the first and second grooved cams 16 and 17 is 40 degrees or more and 140 degrees or less.

After starting the contact opening operation of the puffer type gas circuit breaker, the movable pin 18 moves on the second straight portion 16C until the movable pin 18 reaches the state in FIG. 12, and the lever 12 is at rest. In the states in FIGS. 13 and 14, the movable pin 18 moves on the connecting portion 16B, and the lever 12 is rotated, with the lever fixing pin 15 being a support point. In the states in FIGS. 15 and 16, the movable pin 18 moves on the first straight portion 16A, and the lever 12 is at rest.

In the following, referring to FIGS. 17 to 19, the basis will be described on which the crossing angle of the first and second grooved cams 16 and 17 is set at 40 degrees or more and 140 degrees or less.

Figure 17:
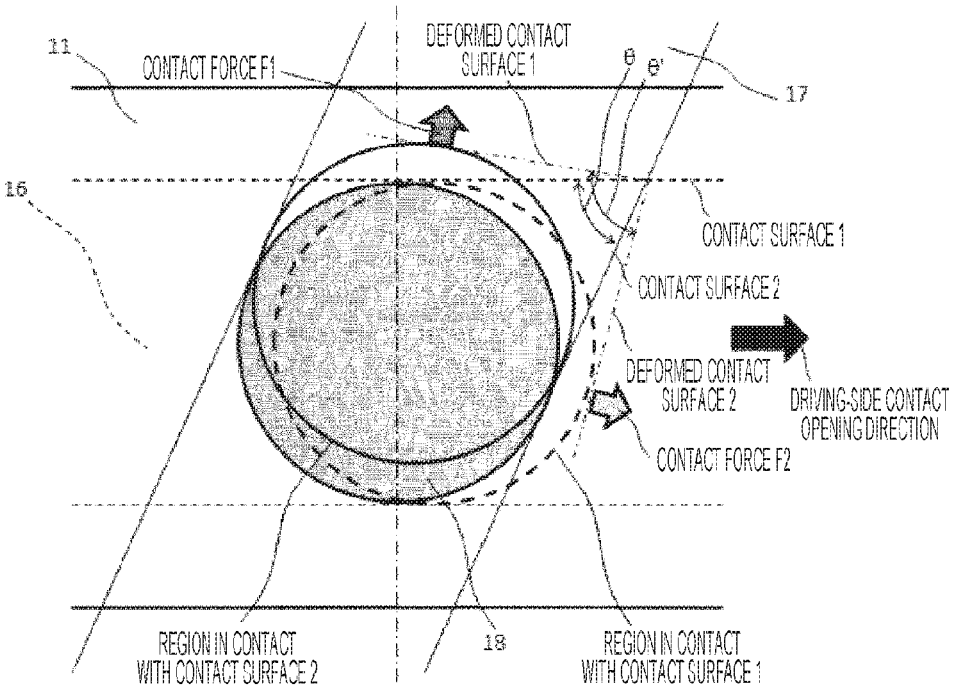
FIG. 17 is a diagram illustrating the deformation of a first grooved cam, a second grooved cam, and the movable pin when a driving-side connecting rod of the puffer type gas circuit breaker according to the second embodiment of the gas circuit breaker according to the present invention is displaced by a minute amount in a driving-side contact opening direction.
Figure 18:
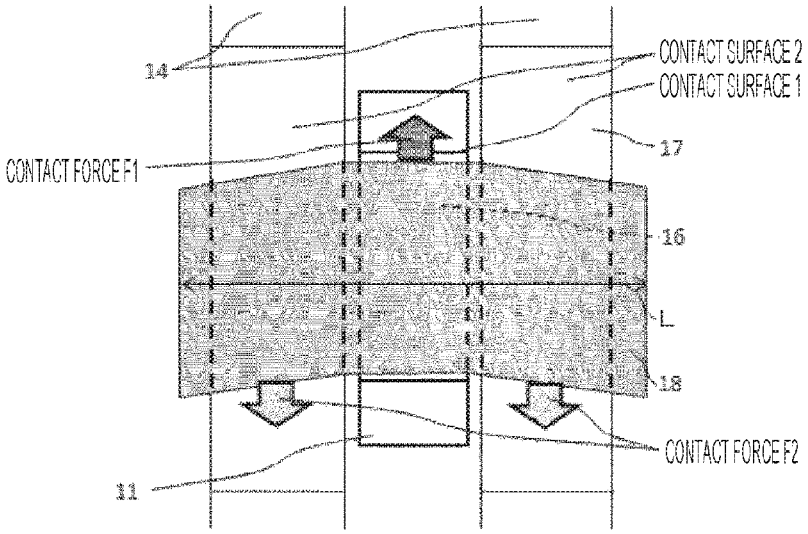
FIG. 18 is a side view of FIG. 17 illustrating the deformation of the grooved cams and the movable pin by a frictional force and a contact force in driving the first grooved cam of the puffer type gas circuit breaker according to the second embodiment of the gas circuit breaker according to the present invention.

FIGS. 17 and 18 illustrate the relationship between the crossing angle of the grooved cams and the contact force in the case in which the first and second grooved cams 16 and 17 and the movable pin 18 are configured of elastic bodies. FIGS. 17 and 18 illustrate the deformation of the first and second grooved cams 16 and 17 and the movable pin 18 when the driving-side connecting rod 11 is displaced in the driving-side contact opening direction by a minute amount.

In FIGS. 17 and 18, in a region in contact with a contact surface 1 of the first grooved cam 16, the movable pin 18 is pulled in the driving-side contact opening direction by a frictional force F and a contact force F2. Thus, the movable pin 18 is deformed in the same direction.

In a region in contact with a contact surface 2 of the second grooved cam 17, the movable pin 18 is pulled in the direction of the angle θ with respect to the driving-side contact opening direction by the frictional force F and the contact force F1. Thus, the movable pin 18 is deformed in the same direction. The deformation of the contact surface 1 of the first grooved cam 16 and the deformation of the contact surface 2 of the second grooved cam 17 locally cause the crossing angle of the grooved. cams at an angle θ' (>θ).

Figure 19:
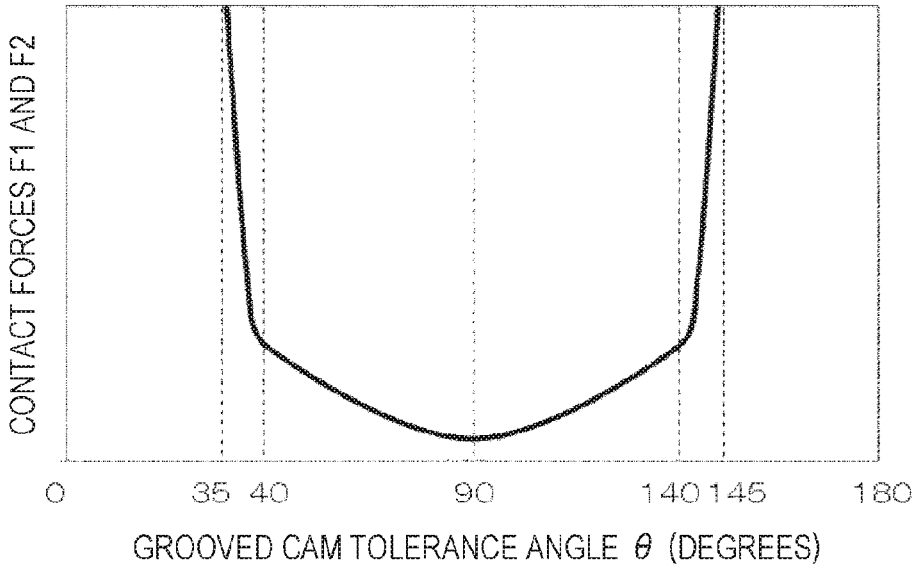
FIG. 19 is a diagram illustrating the result of the analysis of the mechanism depicting the relationship between the crossing angle of the first grooved cam and the second grooved cam and a contact force applied across the grooved cams and the movable pin in the puffer type gas circuit breaker according to the second embodiment of the gas circuit breaker according to the present invention.

FIG. 19 illustrates the result of the analysis of the mechanism, depicting the relationship between. the crossing angle of the first and second grooved cams 16 and 17 and the contact force F1 (F2) applied across the grooved cams and the movable pin 18.

According to FIG. 19, in the range in which the crossing angle θ is 40 degrees or more and 140 degrees or less, it is revealed that the contact forces F1 and F2 are reduced. In FIG. 19, the crossing angle θ is symmetry to θ=90 degrees. In the range of 0 to 40 degrees and the range of 140 to 180 degrees, the contact forces are increased. Thus, in order to reduce the contact force across the first and second grooved cams 16 and 17 and the movable pin 18 at the minimum, the crossing angle has only to be set in the range of 40 degrees or more and 140 degrees or less.

In the more optimum range, the crossing angles θa to θf of the first and second grooved cams 16 and 17 are desirably 90 degrees. At a crossing angle of 90 degrees, an impact force can be relaxed by minimizing the contact force across the first and second grooved cams 16 and 17 and the movable pin 18.

As described above, in order to set the crossing angle of the first and second grooved cams 16 and 17 to 40 degrees or more and 140 degrees or less in all the operation sections, for example, a concept is a design method below.

First, from the optimum stroke characteristics to satisfy breaking duty, the curved shape of the second grooved cam 17 is set in a form of function forms or given coordinate points smoothly connected. At this time, the shapes of two ends of the second grooved cam 17 are defined so that the crossing angle of the first straight portion 16A and the second straight portion 16B of the first grooved cam 16 is 90 degrees. Subsequently, the curve of the second grooved cam 17 is divided into micro sections. Coordinate points are provided in the directions of the direction vectors of the sections and the crossing angle of 40 degrees or more and 140 degrees or less. The coordinate points are smoothly connected to one another to form a curve of the first grooved cam 16.

According to the embodiment, the movable pin 18 extends through the region where the first grooved cam 16, which is driven by the motion of the driving-side components, crosses the fixed second grooved cam 17, and the crossing angle of the first and second grooved cams 16 and 17 is set to 40 degrees or more and 140 degrees or less in all the operation sections. Consequently, a contact force applied to the movable pin 18 is reduced at the minimum. More preferably, the crossing angle is set to 90 degrees. Thus, an impact force across the movable pin 18 and the grooved cams is at the minimum. Therefore, it is possible to provide a highly reliable gas circuit breaker that prevents components from being damaged and from being stuck.

REFERENCE SIGNS LIST

1 controller
2 driving-side main electrode
3 driven-side main electrode
4 driving-side arcing contact
5 driven-side arcing contact
6 shaft
7 mechanical compression chamber
8 nozzle
9 thermal expansion chamber
10 double motion mechanism unit
11 driving-side connecting rod
12 lever
13 driven-side connecting rod
14 guide
15 lever fixing pin
16 first grooved cam
16A first straight portion
16B connecting portion
16C second straight portion
17 second grooved cam
18 movable pin
19 third grooved cam
20 driven-side moving pin
21 lever driven-side guide groove
22 fastening ring
23 driving-side fastening screw
24 lever fixing pin hexagon head
25 lever fixing pin fastening screw
26 lever fixing pin fixing nut

The invention claimed is:

1. A gas circuit breaker comprising a driving-side electrode and a driven-side electrode provided in a sealed tank, the driving-side electrode and the driven-side electrode being opposed to each other, wherein the driving-side electrode has a driving-side main electrode and a driving-side arcing contact, the driven-side electrode has a driven-side main electrode and a driven-side arcing contact, the driving-side arcing contact is in connection to a controller, the driven-side arcing contact is in connection to a double motion mechanism unit, the double motion mechanism unit includes a driving-side connecting rod for receiving a driving force from the driving-side electrode, a driven-side connecting rod in connection to the driven-side arcing contact, a lever for moving the driven-side connecting rod in the opposite direction in response to motion of the driving-side connecting rod, and a guide for defining motion of the driving-side connecting rod and motion of the driven-side connecting rod, the driving-side connecting rod has a first grooved cam, the guide has a second grooved cam, the lever has a third grooved cam, a movable pin extends through the first grooved cam, the second grooved cam, and the third grooved cam, and with motion of the driving side rod, the movable pin moves inside the first grooved cam, the second grooved cam, and the third grooved cam, the lever is rotated, the driven-side connecting rod is driven in a direction opposite to the driving-side connecting rod, and the driven-side arcing contact in connection to the driven-side connecting rod is driven in a direction opposite to the driving-side arcing contact of the driving-side electrode in connection to the driving-side connecting rod.

2. The gas circuit breaker according to claim 1, wherein the first grooved cam is configured of a first straight portion, a second straight portion provided on an axis different from the first straight portion, and a connecting portion connecting the first straight portion to the second straight portion, and a vertical displacement range of the first grooved cam is fit within a vertical displacement range of the second grooved cam and a vertical displacement range of the third grooved cam.

3. The gas circuit breaker according to claim 2, wherein when the movable pin moves inside the first straight portion and the second straight portion, the lever is at rest, and when the movable pin moves inside the connecting portion, the lever is rotated about a support point.

4. The gas circuit breaker according to claim 3, wherein in a contact opening operation of the gas circuit breaker, the movable pin moves inside the second straight. portion, the connecting portion, and the first straight portion in one direction, and in a contact closing operation of the gas circuit breaker, the movable pin moves inside the first straight portion, the connecting portion, and the second straight portion in one direction.

5. The gas circuit breaker according to claim 3, wherein when the movable pin moves inside the connecting portion, the movable pin moves inside the second grooved cam and the third grooved cam in one direction.

6. The gas circuit breaker according to claim 5, wherein in a contact opening operation of the gas circuit breaker, the movable pin moves inside the second straight portion, the connecting portion, and the first straight portion in one direction, and in a contact closing operation of the gas circuit breaker, the movable pin moves inside the first straight portion, the connecting portion, and the second straight portion in one direction.

7. The gas circuit breaker according to claim 2, wherein when the movable pin moves inside the connecting portion, the movable pin moves inside the second grooved cam and the third grooved cam in one direction.

8. The gas circuit breaker according to claim 7, wherein in a contact opening operation of the gas circuit breaker, the movable pin moves inside the second straight portion, the connecting portion, and the first straight portion in one direction, and in a contact closing operation of the gas circuit breaker, the movable pin moves inside the first straight portion, the connecting portion, and the second straight portion in one direction.

9. The gas circuit breaker according to claim 2, wherein in a contact opening operation of the gas circuit breaker, the movable pin moves inside the second straight portion, the connecting portion, and the first straight portion in one direction, and in a contact closing operation of the gas circuit breaker, the movable pin moves inside the first straight portion, the connecting portion, and the second straight portion in one direction.

10. The gas circuit breaker according to claim 2, wherein a relationship of positions of the first straight portion, the second straight portion, the connecting portion of the first grooved cam, the second grooved cam, and the third grooved cam is determined by a velocity ratio of driven-side motion to driving-side motion.

11. The gas circuit breaker according to claim 2, wherein a crossing angle of the first grooved cam and the second grooved cam in all operation sections is 40 degrees or more and 140 degrees or less.

12. The gas circuit breaker according to claim 2, wherein a crossing angle of the first grooved cam and the second grooved cam in all operation sections is 90 degrees.

* * * * *